US005362925A

United States Patent [19]

Yamaguchi et al.

[11] Patent Number: 5,362,925

[45] Date of Patent: Nov. 8, 1994

[54] MULTI-LAYERED INSULATED WIRE FOR HIGH FREQUENCY TRANSFORMER WINDING

[75] Inventors: Tadashi Yamaguchi, Toubu; Masataka Muramatsu, Maruko; Naoki Katagiri, Ueda, all of Japan

[73] Assignee: Totoku Electric Co., Ltd., Tokyo, Japan

[21] Appl. No.: 182,998

[22] Filed: Jan. 18, 1994

Related U.S. Application Data

[62] Division of Ser. No. 929,657, Aug. 12, 1992.

[51] Int. Cl.[5] ..... H01B 7/34

[52] U.S. Cl. ..... 174/120 R; 174/110 FC; 174/110 SR; 174/120 SR

[58] Field of Search ..... 174/120 R, 120 SR, 110 FC, 174/110 SR

[56] References Cited

U.S. PATENT DOCUMENTS

| | | | |
|---|---|---|---|
| 2,795,640 | 6/1957 | Crandall | 174/120 R |
| 3,422,215 | 1/1969 | Humes | 174/120 R |
| 3,425,865 | 2/1969 | Shelton, Jr. | 174/120 R |
| 3,617,617 | 11/1971 | Katz | 174/120 SR |
| 4,273,829 | 6/1981 | Perreault | 174/110 FC |
| 4,401,845 | 8/1983 | Odner et al. | 174/110 FC |
| 4,510,348 | 4/1985 | Arroyo et al. | 174/121 R |
| 4,595,793 | 6/1986 | Arroyo et al. | 174/121 SR |
| 4,801,501 | 1/1989 | Harlow | 174/120 SR |
| 4,841,099 | 6/1989 | Epstein et al. | 219/121.65 |
| 5,220,133 | 6/1993 | Sutherland et al. | 174/120 R |

*Primary Examiner*—Morris H. Nimmo
*Attorney, Agent, or Firm*—Jordan and Hamburg

[57] ABSTRACT

A bundled conductor manufactured by bundling a plurality of small diameter conductors 1, or a bundled conductor 2 manufactured by giving an extremely rough twisting pitch, which is 20 times or more larger than an outer diameter of said bundled conductor, to the bundled conductor is formed. Then, an insulating layer 3 comprising 3 layers 3*a*, 3*b* and 3*c*, each comprising a heat-resistant plastic film, is arranged around the bundled conductor above. A required voltage resistance characteristics is provided and maintained by any 2 of the aforesaid 3 insulating layers, and each of the 3 insulating layers described above is independent respectively and can be separated from other ones.

The multi-layered insulated wire constructed described above is available as an insulated electric wire for a winding to be used in a transformer which satisfies various requirements for safety such as IEC and UL, and with this multi-layered insulated wire it is possible to suppress heat emission in a high frequency switching transformer.

6 Claims, 3 Drawing Sheets

MULTI-LAYERED INSULATED WIRE FOR HIGH FREQUENCY TRANSFORMER WINDING

This is a division, of application Ser. No. 07/929,657 filed Aug. 12, 1992.

BACKGROUND OF THE INVENTION

1. Field of the Invention

This device relates to an insulated wire for a winding suited to be used in a high frequency transformer, a high frequency reactor, or a high frequency coil used in such devices such as a switching power source.

2. Description of the Prior Art

Generally a magnet wire manufactured by forming an insulating layer made of such a material as polyurethane resin or polyester resin on a single wire conductor has been used as an insulated wire for a winding for a switching power source.

A safety transformer for such a device as a switching power source must follow the following restrictions based on IEC (International Electrotechnical Commission) or UL (Standards of Underwriter's Laboratories, Inc.,) as well as on other various types of safety standard;

(1) An insulation resistance must be provided between layers of an electric wire or between the primary and secondary windings with a help of the specified insulating film.

(2) To secure a creepage distance between a winding and a core, a space insulation must be provided with an insulating barrier between the winding and the core.

(3) It is necessary to carry out a processing for insulation by using such a material as an insulating tube when connecting a lead wire to a pin terminal.

Because of the restrictions required by the safety standards as described above, when using a magnet wire, sometimes the user may face many troubles such as difficulty in minimizing a transformer, requirement for parts and processes to carry out various types of processing for insulation, or difficulty in obtaining a compact and high performance transformer. To solve these problems, it has been proposed to use a 3-layered insulated wire for a winding to be used in a transformer, as described in Japanese Utility Model Application No. 49802/1990, Japanese Patent Application No. 150174/1990, and Japanese Utility Model Application No. 49801/1990, and now it is possible to satisfy the safety standards such as IEC or UL.

In a switching power source, a high frequency in a range from several tens KHz to several hundreds KHz is now used for a switching frequency to improve the switching efficiency.

However, in such a high frequency band area as described above, an eddy current loss in a conductor of a transformer winding and a loss due to the skin effect become very large, which causes heat emission from a transformer and may degrade characteristics of not only an insulated electric wire for a winding, but also a transformer itself.

SUMMARY OF THE INVENTION

This invention was made to solve the problems as described above, and the object is to provide an insulated electric wire for a winding to be used in a transformer, which satisfies the various type of requirements for safety as described above and can contribute to reduction of heat emission from a transformer even if the switching frequency is in a high frequency band area.

Firstly, to achieve the object as described above, this invention provides a multi-layered insulated electric wire (called multi-layered insulated wire hereinafter), in which at least 3 insulating layers, each made of a heat-resistant plastic film, wound around a bundled conductor manufactured by bundling a plurality of small diameter conductors substantially in parallel to each other into a conductor having a round cross section, or around a bundled conductor manufactured by giving an extremely long twisting pitch, which is 20 times or more than an outer diameter of the aforesaid conductor, to the aforesaid bundled conductor. The 3 insulating layers are constructed so that a required voltage resistance is provided and maintained by any 2 layers of said 3 ones, and each of the aforesaid 3 insulating layers is independent respectively so that each layer can be separated from other ones.

In a first multi-layered insulated wire for a winding to be used in a high frequency transformer, a small diameter conductor such as a copper wire, a copper alloy wire, or a tin- or solder-plated copper wire is generally used as a conductor for the element wire. A diameter of a conductor is selected case by case according to a specification of a transformer, but generally a conductor having a cross-sectional area in a range from approximately 0.032 mm2 (AWG 32) to 0.52 mm2 (AWG 20) is used, taking into account the high frequency characteristics of a bundled conductor. The reason why a plurality of these small diameter conductors are bundled substantially in parallel to each other into a bundled conductor having a round cross section or an extremely long twisting pitch, which is 20 times or more larger than an outer diameter of a bundled conductor, is given to said conductor is that an eddy current loss in a bundled conductor or a loss due to the skin effect under a high frequency is reduced by raising a contact resistance by means of reducing contact between element wires contacting each other in a bundled conductor.

As an insulating layer for a multi-layered insulating wire, a wound layer manufactured by winding a heat-resistant plastic film such as, for instance, a polyimide film, an aromatic polyamide film, a polyether ether ketone film, a polyphenylene sulfide (PPS) film, or a polyester film in an overlapped relation is used. Also, a heat-sensing adhesive layer may be arranged on the aforesaid heat-resistant plastic film, and after said film is wound around a conductor, heat may be applied to integrate the heat-sensing adhesive layer with the heat-resistant film. Furthermore, if it is necessary, films having different colors may be used for each layer respectively, or each layer may be colored differently by employing such a method as adding a specific dyestuff to each heat-sensing adhesive layer for a film with a heat-sensing adhesive layer to color each layer differently, to clearly identify each insulating layer.

The requirement that each of the 3 insulating layers is independent and can be separated from other layers means that each layer can be separated from other layers and exists as one independent layer. As a means for separating an insulating layer, such a method as using a stripper, removing an insulating layer by giving a slit flaw to the insulating layer, removing an insulating layer by burning and cutting the insulating layer with a heated knife, or winding back a wound film, is available. In contrast to it, a coating for magnet wire is formed by applying insulating varnishes several times around a conductor and baking the varnishes, and each layer can not be separated from other layers, so that sometimes a magnet wire is not recognized as a multi-layered insulating wire.

A bundled conductor according to this invention is manufactured by bundling a plurality of small diameter conductors substantially in parallel into a conductor having a round cross section, or by giving an extremely long twisting pitch, which is 20 times or more larger than an outer diameter of the bundled conductor, so that element wires contacting each other in the bundled conductor form a point contact continuity in the cross section thereof. For this reason, electric resistance of eddy current circuits in the bundled conductor is high and generation of eddy current is suppressed, so that increase of high frequency resistance accompanying an eddy current loss can be prevented. Also, as a conductor surface area of a bundled conductor is far larger than that of a single wire conductor, increase of a loss due to the skin effect can largely be reduced. Furthermore, by giving a twisting pitch, which is 20 times or more larger than an outer diameter of a bundled conductor, to the bundled conductor, a length of used conductor can be shortened by the difference of twisting lengths of the bundled conductor as compared to an ordinary twist line, so that also DC current in the coil can be reduced proportionally.

Also, in the multi-layered insulated wire, at least 3 independent insulating layers, each comprising a heat-resistant plastic film wound around a core, are arranged, and insulating resistance (3.75 kV in case of IEC 950) required by the safety standards are provided and maintained by any 2 of the 3 layers, so that it is accepted as an insulated wire for a winding having appropriate insulating characteristics required by the safety standards and is free from many of the aforesaid regulations required by conventional types of a transformer.

Secondly, to achieve the object as described above, this invention provides a multi-layered insulated electric wire (called multi-layered insulated wire hereinafter), in which at least 3 insulating layers, each made of extruded layer of heat-resistant resin, wound around a bundled conductor manufactured by bundling a plurality of small diameter conductors substantially in parallel to each other with a round cross section, or around a bundled conductor manufactured by giving an extremely long twisting pitch, which is 20 times or more than an outer diameter of the aforesaid conductor, to the aforesaid bundled conductor are arranged. The 3 insulating layers are constructed so that a required voltage resistance is maintained by any 2 layers of said 3 ones, and each of the aforesaid 3 insulating layers is independent respectively so that each layer can be separated from other ones.

In a second multi-layered insulated wire for a winding to be used in a high frequency transformer, a small diameter conductor such as a copper wire, a copper alloy wire, or a tin- or solder-plated copper wire is generally used as a conductor for the element wire. A diameter of a conductor is selected case by case according to a specification of a transformer, but generally a conductor having a cross-sectional area in a range from approximately 0.032 $mm^2$ (AWG 32) to 0.52 $mm^2$ (AWG 20) is used, taking into account the high frequency characteristics of a bundled conductor. The reason why a plurality of these small diameter conductors are bundled substantially in parallel to each other into a bundled conductor having a round cross section or an extremely long twisting pitch, which is 20 times or more larger than an outer diameter of a bundled conductor, is given to said conductor is that an eddy current loss in a bundled conductor or a loss due to the skin effect under high frequency is reduced by raising a contact resistance by means of reducing contact between element wires contacting each other in a bundled conductor.

As an insulating layer for the multi-layered insulated wire, an extruded layer manufactured by extruding a heat-resistant resin such as various types of fluorine resin or various types of engineering plastics several times over a conductor is available. If necessary, each layer may be colored differently by, for instance, using a resin having a different color for each insulating layer respectively, to clearly identify each insulating layer.

The requirement that each layer of 3 insulating layers is independent and can be separated from other layers means that each layer can be separated from other layers and exists as one independent layer. As a means for separating an insulating layer, such a method as using a stripper, removing an insulating layer by giving a slit flaw to the insulating layer, or removing an insulating layer by removing an insulating layer by burning and cutting the insulating layer with a heated knife, is available. In contrast to it, a coating for magnet wire is formed by applying insulating paints several times around a conductor and fusing the paints, and each layer can not be separated from other layers, so that sometimes a magnetic wire is not recognized as a multi-layered insulating wire.

A bundled conductor according to this invention is manufactured by bundling a plurality of small diameter conductors substantially in parallel into a conductor having a round cross section, or by giving an extremely long twisting pitch, which is 20 times or more larger than an outer diameter of the bundled conductor, so that element wires contacting each other in the bundled conductor form a point contact continuity in the cross section thereof. For this reason, electric resistance of eddy current circuits in the bundled conductor is high and generation of eddy current is suppressed, so that increase of high frequency resistance accompanying an eddy current loss can be prevented. Also, as a surface area of a bundled conductor is far larger than that of a single wire conductor, increase of a loss due to the skin effect can largely be reduced. Furthermore, by giving a twisting pitch, which is 20 times or more larger than an outer diameter of a bundled conductor, to the bundled conductor, a length of used conductor can be shortened by the difference of twisting lengths of the bundled conductor as compared to an ordinary twist line, so that also DC current in the coil can be reduced proportionately.

Also, in the multi-layered insulated wire, at least 3 independent insulating layers, each comprising a heat-resistant extruded layer, are arranged, and insulating resistance (3.75 kV in case of IEC 950) required by the safety standards are provided and maintained by any 2 of the 3 layers, so that it is accepted as an insulated wire for a winding having appropriate insulating characteristics required by the safety standards and is free from many of the aforesaid regulations required by conventional types of transformer.

Thirdly, to achieve the object as described above, this invention provides a multi-layered electronic wire (called multi-layered insulating wire hereinafter) for a winding to be used in a transformer; characterized in that at least 2 insulating layers comprising a layer made of a plastic film, an extruded layer of heat-resistant resin, a coated layer of heat-resistant paints, or a combination thereof, are arranged around a bundled insulated conductor manufactured by bundling a plurality of insulated element wires, each having a layer comprising a heat-resistant plastic film wound around a small diameter conductor, an extruded layer made of a heat-resistant resin or a coated layer of heat-resistant paints wound around a small diameter conductor; a required insulation resistance is provided and maintained by any 2 insulating layers of at least the 3 ones comprising an insulating layer for the aforesaid element wire and the 2 insulating layers on the bundled insulated conductor; and each of the 3 insulating layers described above is independent respectively and can be separated from the other ones. The aforesaid bundle insulated conductor according to this invention may be manufactured by bundling a plurality of the aforesaid insulated element wires substantially in parallel to each other into a conductor having a round cross section, or by bundling a plurality of the aforesaid insulated element wires by twisting said element wires by means of bundle-twisting, co-axial twisting, or litz twisting.

In a third multi-layered insulated wire for a winding to be used in a high frequency transformer, generally a small diameter wire such as a copper wire, a copper-alloy wire, or a tin- or solder-plated copper wire is used as a conductor for the element wire. Generally, a size of this small diameter conductor is in a range from 0.08 mm (AWG 40) to 0.20 mm (AEG 32).

As an insulating layer for a multi-layered insulating wire, a layer manufactured by winding a heat-resistant plastic film such as, for instance, a polyimide film, an aromatic polyamide film, a polyether ether ketone film, a polyphenylene sulfide (PPS) film, or a polyester film in an overlapped relation is used. Also, a heat-sensing adhesive layer may be arranged on the aforesaid heat-resistant plastic film, and after said film is wound around a conductor, heat may be applied to integrate the heat-sensing adhesive layer with the heat-resistant film. Furthermore, if it is necessary, films having different colors may be used for each layer respectively, or each layer may be colored differently by employing such a method as adding a specific dyestuff to a heat-sensing adhesive layer for a film with a heat-sensing adhesive layer to color each layer differently, to clearly identify each insulating layer. As an extruded layer made of a heat-resistant resin, an extruded layer manufactured by extruding a heat-resistant resin such as various types of fluorine resin or various types of engineering plastics several times over a conductor is available. If necessary, each layer may be colored differently by, for instance, using a resin having a different color for each insulating layer respectively, to clearly identify each insulating layer.

A coated layer of heat-resistant paints is formed by applying fluorine paints-based dispersion paints, silicon acryl resin, or acryl fluoride-based resin several times. Also in this step, each layer may be colored differently as described above.

The requirement that each layer of 3 insulating layers is independent and can be separated from other layers means that each layer can be separated from other layers and exists as one independent layer. As a means for separating an insulating layer, such a method as using a stripper, removing an insulating layer by giving a slit flaw to the insulating layer, removing an insulating layer by burning and cutting the insulating layer with a heated knife, or winding back a wound film, is available. In contrast to it, a coating for magnet wire is formed by applying insulating varnishes several times around a conductor and baking the varnishes, and each layer can not be separated from other layers, so that sometimes a magnet wire is not recognized as a multi-layered insulating wire.

The bundled insulated conductor according to this invention is manufactured by bundling a plurality of insulated element wires substantially in parallel to each other into one conductor having a round cross section or by twisting a plurality of insulated element wires into a conductor having a round section, and generation of an eddy current can be suppressed to a low level because each element conductor of the insulated element wire is insulated respectively, so that increase of high frequency resistance accompanying an eddy current loss can be prevented. Also in bundled insulated conductor, a surface area of conductor is larger than that of a single wire conductor, and increase of a loss due to the skin effect can largely be suppressed. Also, when a plurality of the aforesaid insulated element wires are bundled into a conductor having a round cross section, or when a plurality of the aforesaid insulated element wires are twisted into a conductor having a round cross section, a length of twisted conductors can be shortened, and also DC current in a coil can be reduced in proportion to the shortened length of the twist conductors.

Also, the multi-layered insulated wire is constructed so that insulation resistance (3.75 kV in case of IEC 950) required by the safety standards is provided and maintained by any 2 insulating layers of the at least 3 insulating layers comprising an insulating layer for the insulated element wire and insulating layers on the bundled insulated conductor, so that the multi-layered insulated wire is accepted as an insulated wire for a winding having appropriate insulation characteristics required by the safety standards, and is free from many of the aforesaid restrictions by conventional types of transformer.

Fourthly, to achieve the object described above, this invention provides a multi-layered insulated element wire for a winding to be used in a transformer (called multi-layered insulated wire hereinafter), in which at least 3 insulating layers, each comprising an extruded layer of heat-resistant resin, are arranged around a bundled conductor manufactured by bundling a plurality of magnet wires, required voltage, resistance characteristics is provided and maintained by any 2 of the 3 layers described above, and each of the 3 insulating layers is independent respectively and can be separated from the other layers.

As the conductor of a fourth multi-layered insulated wire for a winding to be used in a high frequency transformer, a wire manufactured by forming an insulating layer made of such a material as polyurethane resin or polyester resin on a single wire conductor such as a copper wire, a copper-alloy wire, and tin- or solder-plated copper wire is used. Construction of the conductor is selected flexibly according to a specification of a transformer, but generally a conductor comprising a plurality of magnet wires and having a cross-sectional area of 0.032 $mm^2$ (AWG 32) to 0.52 $mm^2$ (AWG 20) is used. The bundled conductor according to this invention may be manufactured by bundling plurality of the aforesaid magnet wires substantially in parallel to each other into a conductor having a round cross section, or by twisting a plurality of the aforesaid magnet wires by means of bundle-twisting, co-axial twisting, or litz twisting into a conductor having a round cross section.

As an insulating layer for the multi-layered insulated wire, an extruded layer manufactured by extruding a heat-resistant resin such as various types of fluorine resin or various types of engineering plastics several times over a conductor is available. If necessary, each layer may be colored differently by, for instance, using a resin having a different color for each insulating layer respectively, to clearly identify each insulating layer.

The requirement that each layer of 3 insulating layers is independent and can be separated from other layers means that each layer can be separated from other layers and exists as one independent layer. As a means for separating an insulating layer, such a method as using a stripper, removing an insulating layer by giving a slit flaw to the insulating layer, or removing an insulating layer by removing an insulating layer by burning and cutting the insulating layer with a heated knife, is available.

A coating of a magnet wire is formed by applying insulating varnishes several times around a conductor and baking the varnishes, but a single insulating layer is formed, so that each layer can not be separated from other layers and the insulating wire is not recognized as a multi-layered insulated wire. Also in this invention, a magnet wire is used, but it is not used in a state of single wire as a multi-layered wire, but as an insulated element wire constituting a bundle conductor.

The bundled conductor according to this invention is manufactured by bundling a plurality of magnet wires substantially in parallel to each other into one conductor having a round cross section or by twisting a plurality of magnet wires into a conductor having a round section, and generation of an eddy current can be suppressed to a low level because each element conductor of the magnet wire is insulated respectively, so that increase of high frequency resistance accompanying an eddy current loss can be prevented. Also in a bundled conductor, a surface area of the conductor is larger than that of a single wire conductor, and an increase of a loss due to the skin effect can largely be suppressed. Also, when a plurality of the aforesaid magnet wires are bundled into a conductor having a round cross section, or when a plurality of the aforesaid magnet wires are twisted into a conductor having a round cross section, a length of twisted conductors can be shortened, and also DC current in a coil can be reduced in proportion to the shortened length of the twisted conductors.

Also, in the multi-layered wire according to this invention, at least 3 independent insulating layers, each made of heat-resistant resin, are arranged, and insulation resistance (3.75 kV in case of IEC 950) is provided and maintained by any 2 of the 3 layers above, so that the multi-layered insulated wire is accepted as an insulated wire for a winding having appropriate insulation characteristics required by the safety standards and is free from many of the restrictions to conventional types of transformer as described above.

Fifthly, to achieve the object as described above, this invention provides a multi-layered insulated electric wire (called multi-layered insulated wire hereinafter), in which at least 3 insulating layers, each comprising a heat-resistant plastic film, wound around a bundled conductor manufactured by bundling a plurality of magnet wires are arranged, required voltage resistance is provided and maintained by any 2 of the 3 layers above, and each of the aforesaid 3 layers is independent respectively and can be separated from other layers.

As the conductor of a fifth multi-layered insulated wire for a winding to be used in a high frequency transformer, a wire manufactured by forming an insulating layer made of such a material as polyurethane resin or polyester resin on a single wire conductor such as a copper wire, a copper-alloy wire, and tin- or solder-plated copper wire is used. Construction of the conductor is selected flexibly according to a specification of a transformer, but generally a conductor comprising a plurality of magnet wires and having a cross-sectional area of 0.032 $mm^2$ (AWG 32) to 0.52 $mm^2$ (AWG 20) is used. The bundled conductor according to this invention may be manufactured by bundling a plurality of the aforesaid magnet wires substantially parallel to each other into a conductor having a round cross section, or by twisting a plurality of the aforesaid magnet wires by means of bundle-twisting, co-axial twisting, or litz twisting into a conductor having a round cross section.

As an insulating layer for a multi-layered insulating wire, a layer manufactured by winding a heat-resistant plastic film such as, for instance, a polyimide film, an aromatic polyamide film, a polyether ether ketone film, a polyphenylene sulfide (PPS) film, or a polyester film in an overlapped relation is used. Also, a heat-sensing adhesive layer may be arranged on the aforesaid heat-resistant plastic film, and after said film is wound around a conductor, heat may be applied to integrate the heat-sensing adhesive layer with the heat-resistant film. Furthermore, if it is necessary, films having different colors may be used for each layer respectively, or each layer may be colored differently by employing such a method as adding a specific dyestuff to a heat-sensing adhesive layer for a film with a heat-sensing adhesive layer to color each layer differently, to clearly identify each insulating layer.

The requirement that each layer of 3 insulating layers is independent and can be separated from other layers means that each layer can be separated from other layers and exists as one independent layer. As a means for separating an insulating layer, such a method as using a stripper, removing an insulating layer by giving a slit flaw to the insulating layer, removing an insulating layer by burning and cutting the insulating layer with a heated knife, or winding back a wound film, is available.

A coating is formed by applying insulating varnishes several times around a conductor and baking the varnishes, but a single insulating layer is formed, so that each layer can not be separated from other layers and the insulating wire is not recognized as a multi-layered insulated wire. Also in this invention, a magnet wire is used, but it is not used in a state of single wire as a multi-layered wire, but as an insulated element wire constituting a bundle conductor.

The bundled conductor according to this invention is manufactured by bundling a plurality of magnet wires substantially in parallel to each other into one conductor having a round cross section or by twisting a plurality of magnet wire into a conductor having a round section, and generation of an eddy current can be suppressed to a low level because each element conductor of the magnet wire is insulated respectively, so that increase of high frequency resistance accompanying an eddy current loss can be prevented. Also in a bundled conductor, a surface area of the conductor is larger than that of a single wire conductor, and increase of a loss due to the skin effect can largely be suppressed. Also, when a plurality of the aforesaid magnet wires are bundled into a conductor having a round cross section, or when a plurality of the aforesaid magnet wires are twisted into a conductor having a round cross section, a length of twisted conductors can be shortened, and also DC current in a coil can be reduced in proportion to the shortened length of the twisted conductors.

Also in the multi-layered insulated wire, at least 3 independent insulating layer, each comprising a heat-resistant plastic film, wound around a conductor are arranged, and insulation resistance required by the safety standards (3.75 kV in case of IEC 950) is provided and maintained by any 2 of the 3 layers above, so that the multi-layered insulated wire is accepted as an insulated wire for a winding having appropriate insulation resistance required by the safety standards and is free from many of the restrictions by conventional types of transformer as described above.

DESCRIPTION OF THE PREFERRED EMBODIMENTS

Description is made for preferred embodiments of this invention with accompanying drawings.

Embodiment 1—1

Figure 1:
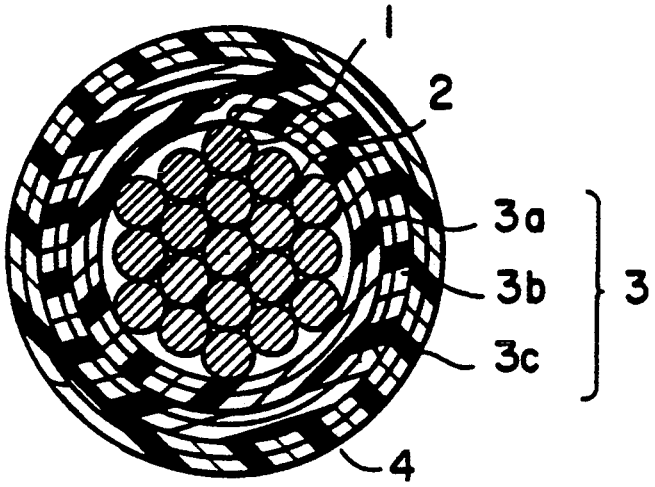
FIG. 1 is a drawing showing a cross section of a first multi-layered insulated wire for a winding to be used in a transformer according to the invention.

FIG. 1 is a drawing showing a cross section of a first embodiment of a multi-layered wire according to the present invention. A copper wire having a diameter of 0.12 mm was used as an element wire conductor 1, and 19 lines of this wire were bundled substantially in parallel into a bundled conductor 2 having a round cross section with an outer diameter of 0.60 mm. Then, a multi-layered insulated wire 4 was manufactured by winding a red PPS film (3.5 mm width×0.03 mm thickness) with ½ laps around this bundled conductor 2 to form a primary insulating layer 3*a*, then winding a white PPS film (3.5 width×0.03 mm thickness) with ½ laps around the primary insulating layer 3*a* described above as a secondary insulating layer 3*b*, and furthermore winding a blue PPS film (3.5 width×0.03 mm thickness) with ½ laps around the secondary insulating layer 3*b* as a tertiary insulating layer 3*c*. Each layer of an insulating layer 3 of this multi-layered insulated wire 4 could be separated from other ones by winding back the films respectively.

Embodiment 1—2

A tin-plated wire having a diameter of 0.12 mm was used as an element wire conductor 1, and 19 lines of this tin-plated wire were bundled into a bundled conductor 2 having a round cross section and a twisting pitch of 24 mm with an outer diameter of 0.60 mm. Then, according to the same procedure as that in embodiment 1, a multi-layered insulated wire 4 was manufactured by arranging the insulating layer 3 comprising layers 3*a*, 3*b* and 3*c*, each comprising a PPS film.

Voltage Resistance Characteristics

Results of withstand voltage tests for the multi-layered wires in embodiments 1—1 and 1—2 carried out by using samples with the insulating layers as described above are as shown in Table 1, and any difference between embodiment 1—1 and embodiment 1—2 was not observed.

TABLE 1

| Sample | Outer diameter (mm) | Breaking test (AC, KV) (1) |
|---|---|---|
| Sample with up to primary insulating layer | 0.720 | 2.2 |
| Sample with up to secondary insulating layer | 0.840 | 6.2 |
| Sample with up to tertiary insulating layer | 0.960 | 9.2 |

Note
(1) indicates a result of breakdown voltage measured by winding each wire around a mandrel with a diameter of 10 mm (with 15 turns).

As clearly shown in Table 1, the insulated wire having the construction as described above could satisfy the voltage resistance characteristics required by IEC 950, namely 3.75 kV for 1 minute.

Temperature Up Test in a Transformer

A switching transformer in which a 3-layered insulated wire according to the embodiment 1—1 of this invention was used as a secondary winding and a switching transformer in which 0.038 mm polyurethane coated copper wire with a diameter of 0.60 mm was used as a secondary winding were manufactured, using the completely same parts and components in other sections. To test a switching transformer with an oscillation frequency of 50 kHz using a switching power source with an output of 136 W, these switching transformers were run under the conditions of output voltage of 161 V and output current of 0.5 A, and surface temperature of the winding in each transformer was measured using a thermistor thermometer. The results are as shown in Table 2.

As clearly shown in Table 2, in the switching transformer in which the multi-layered insulating according to this invention was used, temperature was lower by 6.3° C. than that in the transformer in which a conventional type of single copper wire was used.

TABLE 2

| Secondary winding material | Surface of transformer winding (°C.) | Room (°C.) | Temp. difference ΔT (°C.) |
|---|---|---|---|
| Wire in embodiment 1-1 | 68.9 | 26.3 | 42.6 |
| Polyurethane | 75.2 | 26.3 | 48.9 |

TABLE 2-continued

| Secondary winding material | Surface of transformer winding (°C.) | Room (°C.) | Temp. difference ΔT (°C.) |
|---|---|---|---|
| copper wire | | | |

In the multi-layered insulated wire, a bundled conductor manufactured by bundling a plurality of small diameter conductors substantially in parallel to each other into a conductor having a round cross section, or by giving a twisting pitch, which is 20 times or more larger than an outer diameter of said bundled conductor is used, so that heat emission due to an eddy current loss or the skin effect in the conductor can largely be suppressed, and because of this effect it is possible to suppress heat emission from a switching transformer even when the switching frequency is high, which contributes to improvement of efficiency of a switching power source.

Embodiment 2—1

Figure 2:
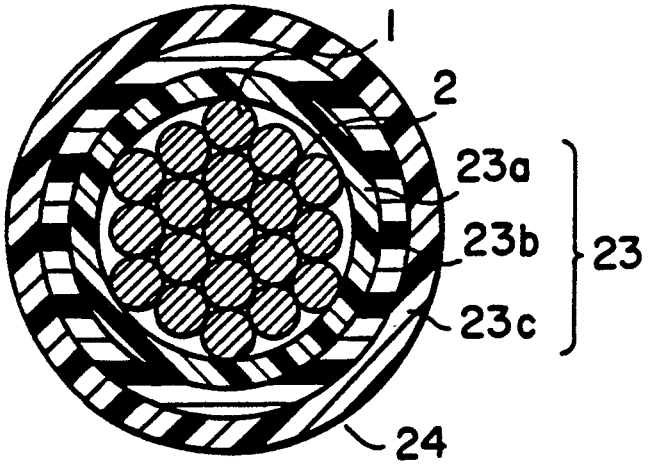
FIG. 2 is a drawing showing a cross section of a second multi-layered insulated wire for a winding to be used in a transformer according to the invention.

FIG. 2 is a drawing showing a cross section of a multi-layered insulated wire according to the second embodiment of this invention. A copper wire having a diameter of 0.12 mm was used as an element wire conductor 1, and 19 lines of this copper wire were bundled substantially in parallel to each other into a bundled conductor 2 having a diameter of 0.60 mm. Then, a multi-layered insulated wire 24 was manufactured by arranging an extruded layer formed by extruding red fluorinated ethylene propylene resin (FEP) (Teflon 100 J, product name of Mitsui Dupont FluoroChemcial Corp.) with a thickness of about 0.06 mm around this bundled conductor 2 as a primary insulating layer 23*a*, arranging an extruded layer formed by extruding natural color FEP with a thickness of about 0.06 mm around the primary insulating layer 23*a* as a secondary insulating layer 23*b*, and furthermore arranging an extruded layer formed by extruding a blue FEP with a thickness of about 0.06 mm around the secondary insulating layer 23*b* as a tertiary insulating layer 23*c*. Each layer of the insulating layer 23 of this multi-layered insulated wire 24 could be separated from other ones by either giving a slit flaw on a surface of the coating or using a stripper.

Embodiment 2—2

A tin-plated copper wire having a conductor diameter of 0.12 mm was used as an element wire conductor 1, and 19 lines of this tin-plated copper wire were formed into a bundled conductor 2 having an outer diameter of 0.60 mm and also having a round cross section by giving a twisting pitch of 24 mm to the bundled conductor. Then, a multi-layered insulated wire 24 was manufactured by arranging an insulating layer 23 comprising 3 extruded layers 23*a*, 23*b*, and 23*c* around this bundled conductor 2 according to the same procedure as that in embodiment 3.

Voltage Resistance Characteristics

Results of withstand voltage tests for the multi-layered insulated wires in embodiment 2—1 and embodiment 2—2 carried out to identify a relation between an outer diameter of a wire and the voltage resistance characteristics using samples having layers as described above are shown in Table 3, and any difference between embodiment 2—1 and embodiment 2—2 was not observed.

As clearly shown in Table 3, the insulated wire having the construction as described above could satisfy the voltage resistance characteristics required by IEC 950, namely 3.75 kV for 1 minute.

TABLE 3

| Sample | Outer diameter (mm) | Breaking test (AC, KV) (1) |
|---|---|---|
| Sample with up to primary insulating layer | 0.720 | 2.1 |
| Sample with up to secondary insulating layer | 0.840 | 6.1 |
| Sample with up to tertiary insulating layer | 0.960 | 9.1 |

Note
(1) indicates a result of breakdown voltage measured by winding each wire around a mandrel with a diameter of 10 mm (with 15 turns).

Temperature Up Test in a Transformer

A switching transformer in which a 3-layered insulated wire according to the embodiment 2—1 of this invention was used as a secondary winding and a switching transformer in which 0.038 mm polyurethane coated copper wire with a diameter of 0.60 mm was used as a secondary winding were manufactured, using the completely same parts and components in other sections. To test a switching transformer with an oscillation frequency of 50 kHz using a switching power source with an output of 136 W, these switching transformers were run under the conditions of output voltage of 161 V and output current of 0.5 A, and surface temperature of the winding in each transformer was measured using a thermistor thermometer. The results are as shown in Table 4.

TABLE 4

| Secondary winding material | Surface of transformer winding (°C.) | Room (°C.) | Temp. difference ΔT (°C.) |
|---|---|---|---|
| Wire in embodiment 2-1 | 68.7 | 26.3 | 42.4 |
| Polyurethane copper wire | 75.2 | 26.3 | 48.9 |

As clearly shown in Table 4, in the switching transformer in which the multi-layered insulation according to this invention was used, temperature was lower by 6.5° C. than that in the transformer in which a conventional type of single copper wire was used.

In the multi-layered insulated wire, a bundled conductor manufactured by bundling a plurality of small diameter conductors substantially in parallel to each other into a conductor having a round cross section, or by giving a twisting pitch, which is 20 times or more larger than an outer diameter of said bundled conductor is used, so that heat emission due to an eddy current loss or the outer skin effect in the conductor can largely be suppressed, and because of this effect it is possible to suppress heat emission from a switching transformer even when the switching frequency is high, which contributes to improvement of efficiency of a switching power source.

Embodiment 3—1

Figure 3:
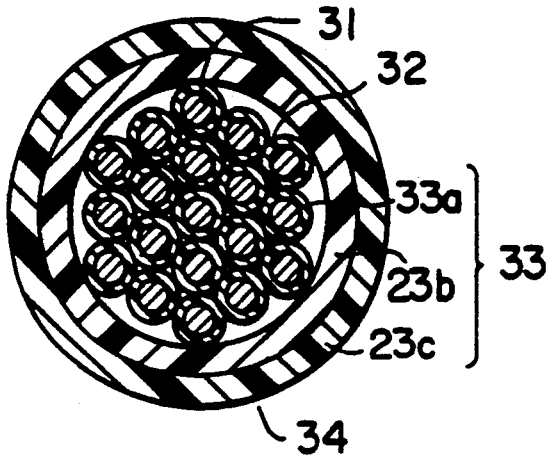
FIG. 3 is a drawing showing a cross section of a third multi-layered insulated wire for a winding to be used in a transformer according to the invention.

FIG. 3 is a drawing showing a multi-layered insulated wire according to the third embodiment of this invention. A copper wire 31 having a diameter of 0.12 mm was used as an element wire conductor 31, and an insulated element wire was manufactured by arranging a primary insulating layer 33a with a coating thickness of 0.04 mm formed by means of applying polytetra fluoroethylene (PTFE) dispersion paints around this copper wire 31. 19 lines of this insulated element wire were bundled into a bundled insulated conductor 32 having an outer diameter of 1.00 mm and also having a round cross section by giving a twisting pitch of 30 mm to the bundled conductor. Then, a 3-layered insulated wire 34 was manufactured by arranging an extruded layer formed by natural color fluorinated ethylene propylene resin (FEP) (Teflon 100 J, product name of Mitsui Dupont Fluoro-Chemical Corp.) with a thickness of about 0.06 mm around this bundled insulated wire 32 as a secondary insulating 23b, and furthermore by arranging an extruded layer formed by extruding blue FEP with a thickness of about 0.06 mm around this secondary insulating layer 23b as a tertiary 23c. Each layer of the insulating layer 23 of this 3-layered insulated wire 34 could be separated from other ones by a giving a slit flaw on a surface of the coating or by using a stripper.

Embodiment 3—2

Figure 4:
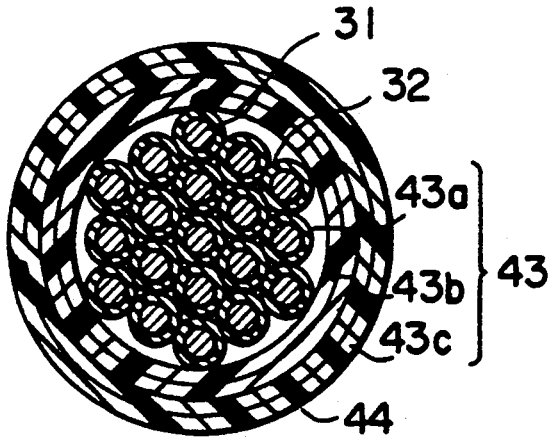
FIG. 4 is a drawing showing a cross section of another embodiment of the third multi-layered insulated wire for a winding to be used in a transformer according to the invention.

FIG. 4 is a drawing showing a cross section of a multi-layered insulated wire which is a modified one according to the third embodiment of this invention. A copper wire having a conductor diameter of 0.12 mm was used as an element wire conductor 31, and an insulating element wire was manufactured by arranging a primary insulating layer 43a by means of extruding natural color FEP with a thickness of 0.04 mm. Then, 19 lines of this element insulated wire were bundled substantially in parallel to each other into a bundled insulated conductor 42 having a round cross section and also having an outer diameter of 1.00 mm. Then, a 3-layered insulated wire 44 was manufactured by arranging a secondary insulating layer 43b by means of winding a white PPS film (3.5 mm width×0.03 mm thickness) with ½ laps around this bundled insulated conductor 42, and furthermore by arranging a tertiary insulating layer 43c by means of winding a white PPS film (3.5 mm width ×0.03 thickness) with ½ laps around the secondary insulating layer 42. The primary insulating layer 43a, the secondary insulating layer 43b and the tertiary insulating layer 43c of the insulating layer 43 in this 3-layered insulated wire 44 could be separated by winding back each film respectively.

Voltage Resistance Characteristics

Results of withstand voltage tests for the multi-layered insulated wires in embodiment 3—1 and embodiment 3—2 carried out to identify a relation between an outer diameter of a wire and the voltage resistance characteristics using samples having layers as described above are shown in Table 5, and any difference between embodiment 3—1 and embodiment 3—2 was not observed.

TABLE 5

| Sample | Outer diameter (mm) | Breaking test (AC, KV) (1) |
|---|---|---|
| Sample with up to primary insulating layer | 1.00 | 2.0 |
| Sample with up to secondary insulating layer | 1.12 | 5.9 |
| Sample with up to tertiary insulating layer | 1.24 | 9.0 |

TABLE 5-continued

Note
(1) indicates a result of breakdown voltage measured by winding each wire around a mandrel with a diameter of 10 mm (with 15 turns). As clearly shown in Table 5, the insulated wire having the construction as described above could satisfy the voltage resistance characteristics required by IEC 950, namely 3.75 KV for 1 minute.

Temperature Up Test in a Transformer

A switching transformer in which a 3-layered insulated wire according to the embodiment 3—1 of this invention was used as a secondary winding and a switching transformer in which 0.038 mm polyurethane coated copper wire with a diameter of 0.60 mm was used as a secondary winding were manufactured, using the completely same parts and components in other sections. To test a switching transformer with an oscillation frequency of 50 kHz using a switching power source with an output of 136 W, these switching transformers were run under the conditions of output voltage of 161 V and output current of 0.5 A, and surface temperature of the winding in each transformer was measured using a thermistor thermometer. The results are shown in Table 6.

As clearly shown in Table 6, in the switching transformer in which the multi-layered insulating according to this invention was used, temperature was lower by 6.3° C. than that in the transformer in which a conventional type of single copper wire was used.

TABLE 6

| Secondary winding material | Surface of transformer winding (°C.) | Room (°C.) | Temp. difference ΔT (°C.) |
|---|---|---|---|
| Wire in embodiment 3-1 | 68.9 | 26.3 | 42.6 |
| Polyurethane copper wire | 75.2 | 26.3 | 48.9 |

In the multi-layered insulated wire, a bundled insulated conductor manufactured by bundling a plurality of insulated conductors substantially in parallel to each other into a conductor having a round cross section, or by twisting a plurality of the aforesaid insulated element wires into a conductor having a round cross section is used, so that heat emission due to an eddy current loss or the skin effect in the conductor can largely be suppressed, and because of this effect it is possible to suppress heat emission from a switching transformer even when the switching frequency is high, which contributes to improvement of efficiency of a switching power source.

Embodiment 4—1

Figure 5:
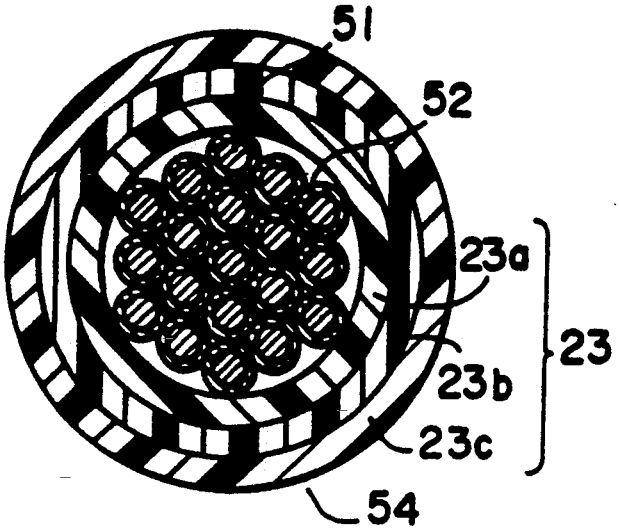
FIG. 5 is a drawing showing a cross section of a fourth multi-layered insulated wire for a winding to be used in a transformer according to the invention.

FIG. 5 is a drawing showing a cross section of a multi-layered wire according to a fourth embodiment of this invention. A class 2 polyurethane having a diameter of 0.10 mm and a finished diameter of 0.120 mm as a magnet wire 51 was used, and a bundled conductor 52 having a diameter of 0.60 mm was formed by bundling 19 lines of this polyurethane copper wire substantially in parallel to each other. Then, a multi-layered insulated wire 54 was manufactured by arranging an extruded layer formed by extruding red fluorinated ethylene propylene resin (FEP) (Teflon 100 J. product name of Mitsui Dupont FluoroChemial Corp.) with a thickness of about 0.06 mm around this bundled conductor 52 as a primary insulating layer 23*a*, arranging an extruded layer formed by extruding natural color FEP with a thickness of about 0.06 mm around the primary insulating layer as a secondary insulating layer 23*b*, and furthermore arranging an extruded layer formed by extruding a blue FEP with a thickness of about 0.06 mm around the secondary insulating layer 23*b* as a tertiary insulating layer 23*c*. Each layer of the insulating layer 23 of this multi-layered insulated wire 54 could be separated from other ones by either giving a slit flaw on a surface of the coating or using a stripper.

Embodiment 4—2

A class 2 polyester copper wire having a diameter of 0.10 mm and a finished outer diameter of 0.120 mm was used as a magnet wire 51, and a bundled conductor with a bundled outer diameter of 0.60 mm was manufactured by bundling 19 lines of these polyester copper wires into a conductor having a round cross section with a twisting pitch of 24 mm. Then, a multi-layered insulated wire 54 was manufactured by arranging an insulated layer 23 comprising 3 FEP extruded layers 23*a*,23*b* and 23*c* around this bundled conductor like in embodiment 4—1. Each insulating layer in this multi-layered insulated wire 54 could be separated according to the same procedure as that in embodiment 4—1.

Voltage Resistance Characteristics

Results of withstand voltage tests for the multi-layered insulated wires in embodiment 4—1 and embodiment 4—2 carried out to identify a relation between an outer diameter of a wire and the voltage resistance characteristics using samples having layers as described above are shown in Table 7, and any difference between embodiment 4—1 and embodiment 4—2 was not observed.

TABLE 7

| Sample | Outer diameter (mm) | Breaking test (AC, kV) (1) |
|---|---|---|
| Sample with up to primary insulating layer | 0.721 | 2.2 |
| Sample with up to secondary insulating layer | 0.841 | 6.2 |
| Sample with up to tertiary insulating layer | 0.961 | 9.2 |

Note
(1) indicates a result of breakdown voltage measured by winding each wire around a mandrel with a diameter of 10 mm (with 15 turns).

As clearly shown in Table 7, the insulated wire having the construction as described above could satisfy the voltage resistance characteristics required by IEC 950, namely 3.75 kV for 1 minute.

Temperature Up Test in a Transformer

A switching transformer in which a 3-layered insulated wire according to the embodiment 4—1 of this invention was used as a secondary winding and a switching transformer in which 0.038 mm polyurethane coated copper wire with a diameter of 0.60 mm was used as a secondary winding were manufactured, using the completely same parts and components in other sections. To test a switching transformer with an oscillation frequency of 50 kHz using a switching power source with an output of 136 W, these switching transformers were run under the conditions of output voltage of 161 V and output current of 0.5 A, and surface temperature of the winding in each transformer was measured using a thermistor thermometer. The results are as shown in Table 8.

As clearly shown in Table 8, in the switching transformer in which the multi-layered insulating according to this invention was used, temperature was lower by 7.7° C. than that in the transformer in which a conventional type of single copper wire was used.

TABLE 8

| Secondary winding material | Surface of transformer winding (°C.) | Room (°C.) | Temp. difference ΔT (°C.) |
|---|---|---|---|
| Wire in embodiment 4-1 | 67.5 | 26.3 | 41.2 |
| Polyurethane copper wire | 75.2 | 26.3 | 48.9 |

In the multi-layered insulated wire according to this invention, a bundled conductor having a round cross section prepared by bundling a plurality of magnet wires, or by twisting a plurality of magnet wires is used, so that heat emission due to an eddy current loss and the skin effect in the conductor can largely be reduced, and because of this effect also it is possible to suppress heat emission in a high frequency switching transformer, which can contribute to improvement of the switching efficiency.

Embodiment 5—1

Figure 6:
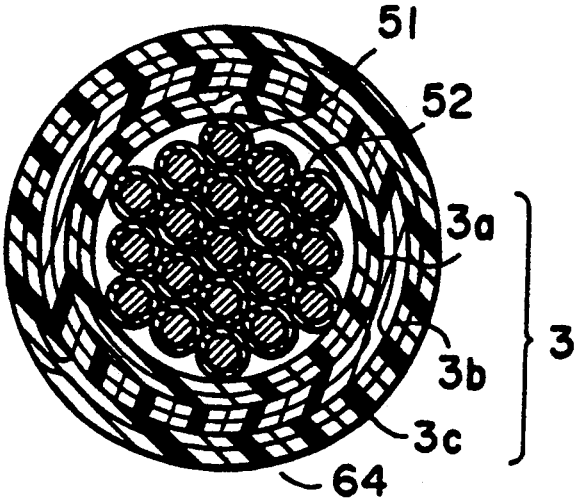
FIG. 6 is a drawing showing a cross section of a fifth multi-layered insulated wire for a winding to be used in a transformer according to the invention.

FIG. 6 is a drawing showing a cross section of a multi-layered insulated wire according to a fifth embodiment of this invention. A class 2 polyurethane copper wire having a diameter of 0.10 mm and a finished diameter of 0.120 mm was used as a magnet wire 51, and 19 lines of this polyurethane copper wire were bundled in parallel into a bundled insulated conductor 52 having a diameter of 0.60 mm. Then, a multi-layered insulated wire 64 was manufactured by arranging a layer formed by means of winding a red PPS film (3.5 mm width×0.03 mm thickness) in ½ laps around this bundled insulated conductor 52 as a primary insulating layer 3*a*, arranging a layer formed by means of winding a white PPS film (3.5 mm width×0.03 mm thickness) in ½ laps around this primary insulating layer 3*a* as a secondary insulating layer 3*b*, and furthermore arranging a layer formed by winding a blue PPS film (3.5 mm width×0.3 mm thickness) in ½ laps around the secondary insulating layer 3*b* as a tertiary insulating layer 3*c*. Reference numeral 3 in FIG. 6 represents an insulating layer. Each layer in this multi-layered insulated wire 64 could be separated from other ones by winding back each film.

Embodiment 5—2

A class 2 polyester copper wire having a diameter of 0.10 mm and a finished outer diameter of 0.120 mm was used as a magnet wire 51, and a bundled insulated conductor 52 having a bundled diameter of 0.60 mm was manufactured by bundling 19 lines of this polyester copper wire into a conductor having a round cross section with a twisting pitch of 24 mm. Then, a multi-layered insulated 64 was manufactured by arranging a layer formed by means of winding a red polyester film (3.5 mm width×0.03 mm thickness) around this bundled insulated conductor 52 in ½ laps as a primary insulating layer 3a, arranging a layer formed by winding a white polyester film (3.5 mm width×0.3 mm thickness) around the primary insulating layer 3a in ½ laps as a secondary insulating layer 3b, and furthermore arranging a layer formed by winding a blue polyester film (3.5 mm width×0.03 mm thickness) around this secondary insulating layer 3b in ½ laps as a tertiary insulating layer 3c. Reference numeral 3 in FIG. 6 represents an insulating layer. Each layer in this multi-layered insulated wire could be separated with a stripper.

Voltage Resistance Characteristics

Results of withstand voltage tests for the multi-layered insulated wires in embodiment 5—1 and embodiment 5—2 carried out to identify a relation between an outer diameter of a wire and the voltage resistance characteristics using samples having layers as described above are shown in Table 9, and any difference between embodiment 5—1 and embodiment 5—2 was not observed.

TABLE 9

| Sample | Outer diameter (mm) | Breaking test (AC, kV) (1) |
|---|---|---|
| Sample with up to primary insulating layer | 0.720 | 2.2 |
| Sample with up to secondary insulating layer | 0.840 | 6.2 |
| Sample with up to tertiary insulating layer | 0.960 | 9.2 |

Note
(1) indicates a result of breakdown voltage measured by winding each wire around a mandrel with a diameter of 10 mm (with 15 turns). As clearly shown in Table 9, the insulated wire having the construction as described above could satisfy the voltage resistance characteristics required by IEC 950, namely 3.75 kV for 1 minute.

Temperature Up Test in a Transformer

A switching transformer in which a 3-layered insulated wire according to the embodiment 5—1 of this invention was used as a secondary winding and a switching transformer in which 0.038 mm polyurethane coated copper wire with a diameter of 0.60 mm was used as a secondary winding were manufactured, using the completely same parts and components in other sections. To test a switching transformer with an oscillation frequency of 50 kHz using a switching power source with an output of 136 W, these switching transformers were run under the conditions of output voltage of 161 V and output current of 0.5 A, and surface temperature of the winding in each transformer was measured using a thermistor thermometer. The results are as shown in Table 10.

As clearly shown in Table 10, in the switching transformer in which the multi-layered insulating according to this invention was used, temperature was lower by 7.5° C. than that in the transformer in which a conventional type of single copper wire was used.

TABLE 10

| Secondary winding material | Surface of transformer winding (°C.) | Room (°C.) | Temp. difference ΔT (°C.) |
|---|---|---|---|
| Wire in embodiment 5-1 | 67.7 | 26.3 | 41.4 |
| Polyurethane copper wire | 75.2 | 26.3 | 48.9 |

In the multi-layered insulated wire according to this invention, a bundled conductor having a round cross section prepared by bundling a plurality of magnet wires, or by twisting a plurality of magnet wires is used, so that heat emission due to an eddy current loss and an outer skin effect in the conductor can largely be reduced, and because of this effect also it is possible to suppress heat emission in a high frequency switching transformer, which can contribute to improvement of the switching efficiency.

What is claimed is:

1. A multi-layered insulated electric wire for a winding to be used in a high frequency switching power transformer comprising:

a plurality of small diameter conductors bundled together to form a bundled conductor having a round cross-section;

at least three insulating layers, each comprising an extruded layer of a heat resistant material formed around said bundled conductor;

any two insulating layers of said at least three insulating layers providing an insulating resistance of 3.75 kV for one minute; and each of said at least three insulating layers being independent of each other and being separable from the other layers.

2. A multi-layered insulated electric wire for a winding to be used in a high frequency switching power transformer according to claim 1 wherein:

said plurality of small diameter conductors of the aforesaid bundled conductor are substantially parallel to each other.

3. A multi-layered insulated electric wire for a winding to be used in a high frequency switching power transformer according to claim 1 wherein:

said plurality of small diameter conductors of the aforesaid bundled conductor are twisted around each other.

4. A multi-layered insulated electric wire for a winding to be used in a high frequency switching power transformer comprising:

a plurality of magnet wires, each of said magnet wires individually having a coating of a heat resistant varnish, said plurality of magnet wires being bundled together to form a bundled insulated conductor;

at least three insulating layers, each comprising an extruded layer of a heat resistant plastic material formed around said bundled conductor;

any two insulating layers of said at least three insulating layers providing an insulating resistance of 3.75 kV for one minute; and each of the aforesaid at least three insulating layers being independent of one another and being separable from the other layers.

5. A multi-layered insulated electric wire for a winding to be used in a high frequency switching power transformer according to claim 4 wherein:

said plurality of magnet wires of said bundled conductor being substantially parallel to each other.

6. A multi-layered insulated electric wire for a winding to be used in a high frequency switching power transformer according to claim 4, wherein:

said plurality of magnet wires of said bundled conductor being twisted around each other.

* * * * *